United States Patent [19]

Guarnaschelli et al.

[11] 4,193,755

[45] Mar. 18, 1980

[54] LIQUID TO GAS FUEL CONVERSION BURNER DEVICE

[75] Inventors: Vincent Guarnaschelli, Greenlawn; Mitchell Reiss, Dix Hills, both of N.Y.

[73] Assignee: R & G Energy Research Corporation, New York, N.Y.

[21] Appl. No.: 903,089

[22] Filed: May 5, 1978

[51] Int. Cl.[2] ..... F23D 11/44

[52] U.S. Cl. ..... 431/207; 431/208; 431/210; 219/271; 219/552

[58] Field of Search ..... 219/271, 273, 275, 276, 219/552; 431/208, 207, 11, 41, 36, 210

[56] References Cited

U.S. PATENT DOCUMENTS

| | | | |
|---|---|---|---|
| 1,688,796 | 10/1928 | Baker | 219/275 |
| 1,959,031 | 5/1934 | Masters | 431/11 |
| 2,216,178 | 10/1940 | Astraddson | 431/11 |
| 2,726,715 | 12/1955 | Tegtmeyer | 431/208 |
| 3,869,242 | 3/1975 | Schladitz | 431/208 |
| 4,013,396 | 3/1977 | Tenny | 431/208 |

*Primary Examiner*—Carroll B. Dority, Jr.
*Assistant Examiner*—Lee E. Barrett
*Attorney, Agent, or Firm*—Richard L. Miller

[57] ABSTRACT

A fuel burning apparatus which receives liquid fuel and converts it into a fine fume which is then mixed with air and conveyed to a burner where the mixture of the fuel and air is burned. The fuel is supplied from a supply tank and dripped onto a heating element having a spiral path formed around its outside. The drop of fuel are collected by means of a funnel placed near the end of the heating element to catch the drops and direct it onto the spiral path. As the drops of fuel proceed along the spiral path around the heating element, the fuel is converted into fine fumes. The heating elements are positioned in a mixing chamber which includes an air inlet to permit air under low pressure to pass into the mixing chamber and mix with the fumes of the fuel. The mixture then passes out of the mixing chamber into a storage chamber which provides the supply of fuel and air to a burner.

17 Claims, 3 Drawing Figures

LIQUID TO GAS FUEL CONVERSION BURNER DEVICE

BACKGROUND OF THE INVENTION

This invention relates to fuel burning devices and more particularly to a method and apparatus for converting liquid fuel to gas fuel and utilizing the gas fuel for a burner.

Fuel burning equipment are well known and are of numerous different types. Essentially, the type of equipment will depend on the fuel being utilized. Some equipment are designed to receive solid fuel such as coal while others are able to utilize gas fuel. One of the most popular types of fuel burning equipment are those which utilize liquid fuel as either oil, kerosene, gasoline, or standard heating number 2 fuel.

The fuel burning equipment, especially of the liquid fuel type are utilized for numerous purposes. For example they can be in the form of an oil furnace for use in home heating equipment. Additionally, such liquid fuel burning equipment is also utilized as part of hot water heaters, stoves, industrial boilers, and even the internal combustion engine can be considered as such as liquid fuel burning system.

Most of the conventional liquid fuel burning devices take the liquid fuel, such as oil, and atomize the oil into small drops by means of pressure. The air pressure can be supplied by a motor driven fan or a rotary burner type. In such cases, the atomized liquid fuel mixed with the air is sent to a burner where the heat and flame is produced. Other types of oil burners send the oil directly into the furnace chamber. The oil is permitted to give off some of its vapor and this vapor flows upwardly in the furnace toward the burner which is positioned at the top. As it moves upward, it combines with air and this combination is then burned.

One of the main problems with existing types of fuel burning equipment concerns the efficiency of operation. Part of the reduced efficiency occurs in the lack of utilization of all of the fuel. There is much fuel waste in all types of existing equipment since not all of the fuel is atomized or vaporized and accordingly many liquid particles remain. Some of these liquid particles are not utilized at all and accordingly reduces the amount of output heat from a given supply of fuel. An additional loss of efficiency results in the fact that much of the fuel remains in its liquid form in larger particles and cannot burn during the given amount of time for the burning cycle. As a result, these particles are never sufficiently converted into heat and provide another source of heat loss.

In addition to actual heat loss and lack of efficiency of existing equipment, the conventional type of burners, and especially oil burning equipment, produce a tremendous amount of pollutants. Much of the liquid fuel particles are converted into soot and other waste products which pollute the atmosphere as well as providing dirt in the environment around the fuel burning equipment. Also, the lack of complete burning produces smoke and other odors in the environment also tending the pollute the atmosphere.

Other problems also exist in connection with the present type of fuel burning equipment, and especially the oil burners. Because the liquid fuel is either atomized or the vapors form naturally from the fuel, there still exists large particles of liquid fuel throughout the burner. These tend to clog the holes in the conventional burner which can often create a dangerous system whereby an inefficient amount of fuel and air mixture is provided. Also, when a sufficient number of the holes are clogged and are not properly maintained, explosions could also frequently occur in the furnace or fuel burning equipment.

SUMMARY OF THE INVENTION

Accordingly, it is an object of the present invention to provide a method and apparatus for burning fuel, and especially liquid fuel, which avoids the aforementioned problems of prior art devices.

A further object of the present invention is to provide a fuel burning apparatus which completely converts the liquid fuel into fine fumes which can then be mixed with air and conveyed to a burner for a more efficient fuel burning apparatus.

Still a further object of the present invention is to provide a fuel burning apparatus including a specially designed heating device for converting the liquid fuel into its gas fumes for subsequent mixing with air to provide a mixture for a fuel burner.

Yet a further object of the present invention is to provide a spiral heating element for use in converting liquid fuel to its gas fumes for use in a fuel burning apparatus.

Still a further object of the present invention is to provide a fuel burning apparatus including a specially designed mixing chamber where liquid fuel can be almost entirely converted into its gas vapor and mixed with air to provide an improved fuel mixture for use in a burner.

A further object of the present invention is to provide a fuel burning apparatus which is more efficient, substantially odorless, substantially without any soot, and more effective then conventional fuel burning apparatus.

Yet another object of the present invention is to provide a method of burning fuel by heating liquid fuel to convert it almost entirely into fumes which can be mixed with air to provide an improved fuel burning apparatus.

Yet a further object of the present invention is to provide a fuel burning apparatus comprising a unique heating element which can accept fuel of a liquid type, convert it into fine fumes which are mixed with air to become a combustible mixture which is supplied to a burner to produce a high efficient burning device.

Briefly, the invention comprises a fuel burning apparatus which includes a heating device for receiving a liquid fuel and converting it almost entirely into fine fumes. The fumes, or vapor, are mixed with air to provide a combustible mixture. A conveying device transports the mixture to a burner where the combustible mixture is burned.

In an embodiment of the invention, the heating device includes at least one heating element having a spiral path around the outside thereof. A receiver is connected to the heating element in order to receive all of the liquid fuel and direct it onto the spiral path. In this manner, the liquid fuel flows around the heating element until it is almost entirely converted into the fine fumes. The heating elements are positioned in a mixing tank having an air inlet and an outlet. Air under low pressure is sent into the mixing tank and traverses the heating element to mix with the fumes. The mixture then leaves through the outlet means and through a conveying device to the burner.

The invention also contemplates a method of burning fuel including the steps of heating the liquid fuel in order to convert it almost entirely into fine fumes or vapor. The fine fumes are mixed with the air and supplied to the burning device.

In an embodiment of the invention, the heating is achieved by applying the fuel in individual drops onto a heating element and directing the fuel along the outer surface of the heating element until it is almost entirely converted to the fine fumes. Air is then passed across the heating element to provide the combustible mixture which is then supplied to the burner.

The invention also contemplates a unique heating element having a spiral path therearound. The heating element is of the electrical kind whereby the ends can be connected to an electrical power supply. The spiral can be formed of stiff absorbing material, such as stranded wire which is wound around the outside of the heating element. A funnel is positioned at the ends of the heating element to collect the liquid fuel which is dripped into the funnel and then sent through the stranded wire around the heating element until it is almost entirely converted into fine fumes.

The aforementioned objects, features and advantages of the invention will, in part, be pointed out with particularity, and will, in part, become obvious from the following more detailed description of the invention taken in conjunction with the accompanying drawings, which form an integral part thereof.

BRIEF DESCRIPTION OF THE DRAWINGS

In the drawings.

In the various figures of the drawings like reference characters designate like parts.

DESCRIPTION OF THE PREFERRED EMBODIMENTS

Figure 1:
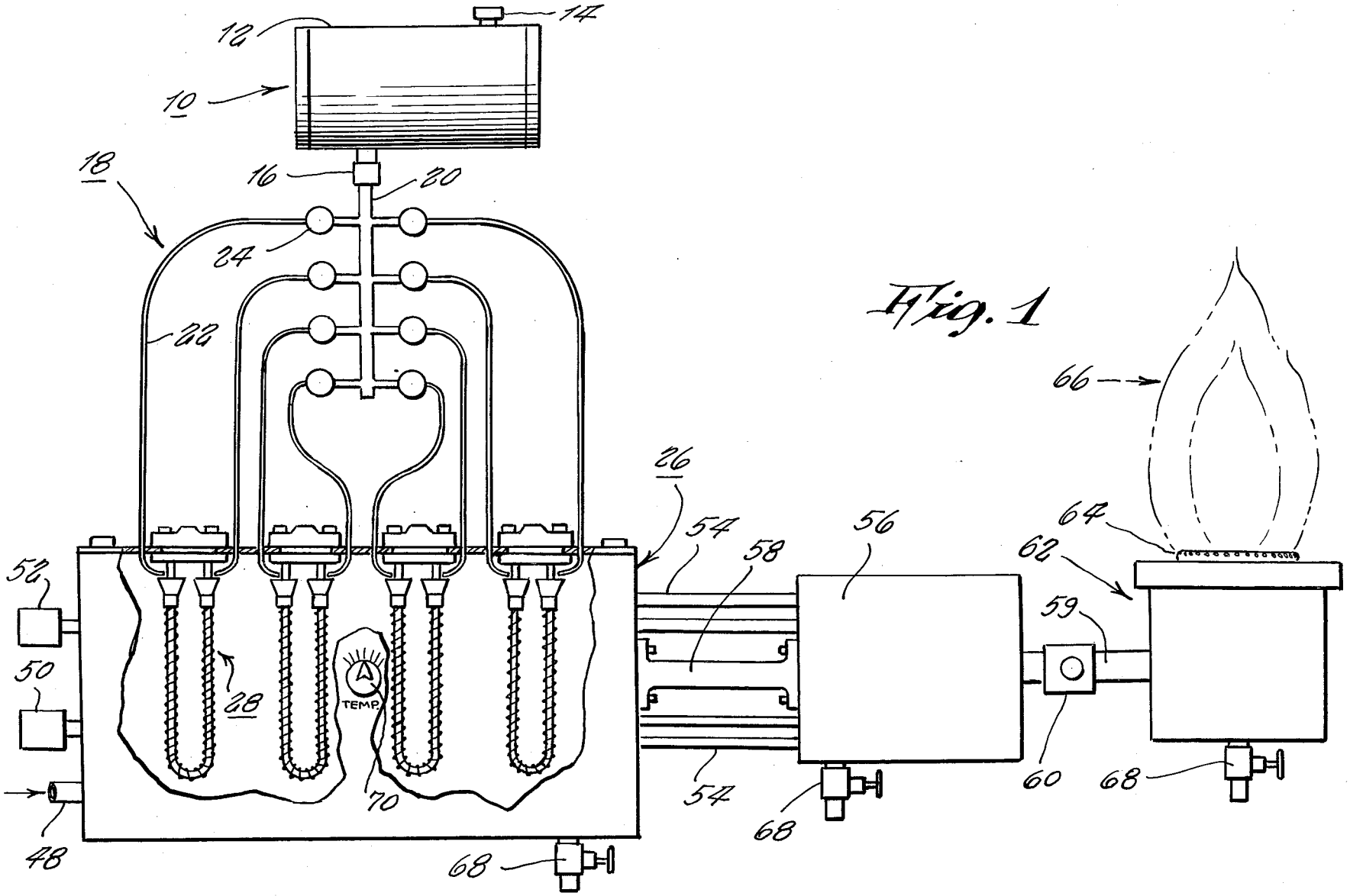
FIG. 1 is a schematic drawing of the fuel burning apparatus of the present invention and wherein the mixing tank is shown partly cut away.

Referring now to FIG. 1, the fuel burning apparatus of the present invention is shown to include a fuel supply shown generally at 10 and including a fuel tank 12 with an inlet nozzle 14 and an outlet control 16. The tank is typically a gravity feed tank whereby the fuel will automatically flow down through a valve control system shown generally at 18. The control system includes a main flow tube 20 with a plurality of individual capillary feed tubes 22 flowing from the main tube 20. In each of the capillary tubes is provided a needle valve 24, or other similar type of valve, which is capable of regulating the flow of liquid fuel so as to reduce its flow down to a drip rate.

The liquid fuel is provided into a mixing tank shown generally at 26 which can be formed of steel, or other such similar material. Positioned in the mixing tank 26 are a plurality of heating devices shown generally at 28. Each of the heating devices are connected in parallel.

Figure 2:
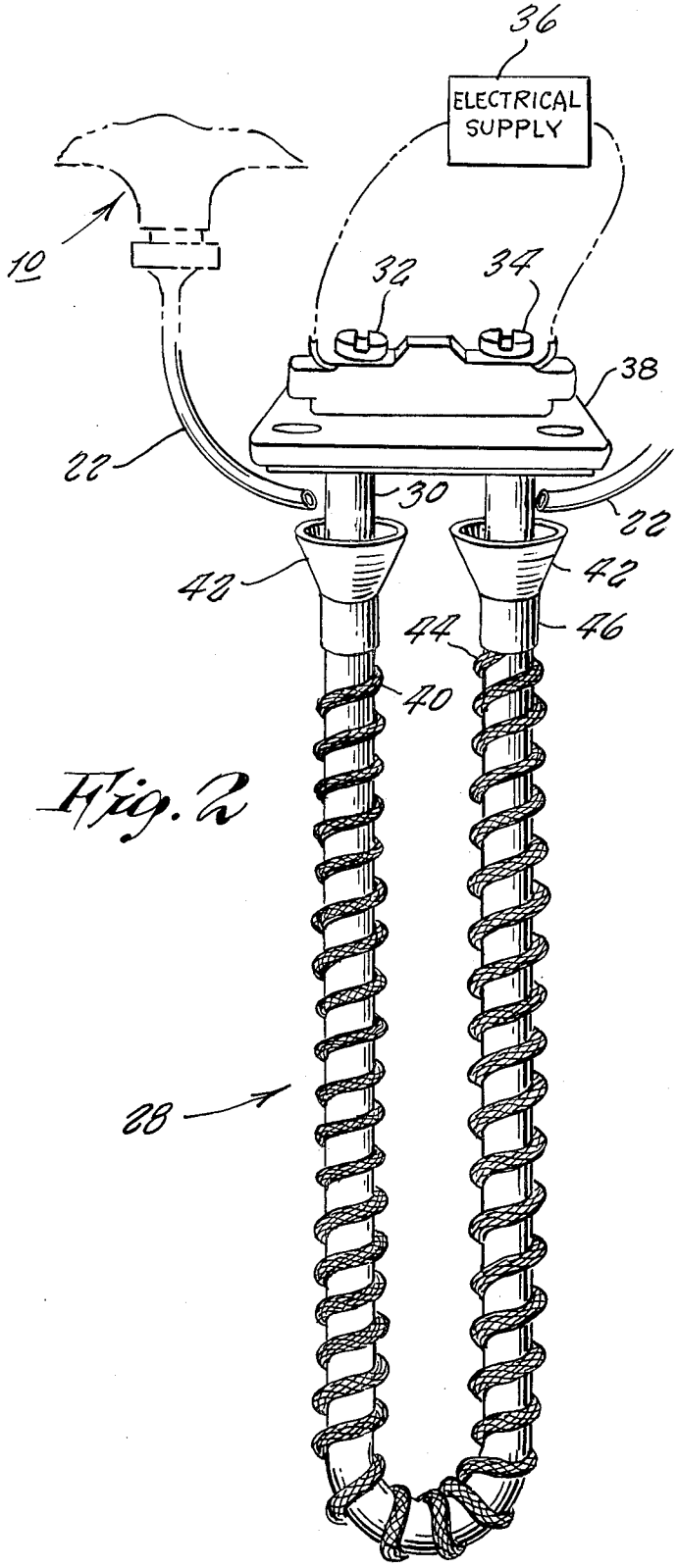
FIG. 2 is an isometric drawing of one of the heating elements utilized in the apparatus shown in FIG. 1.
Figure 3:
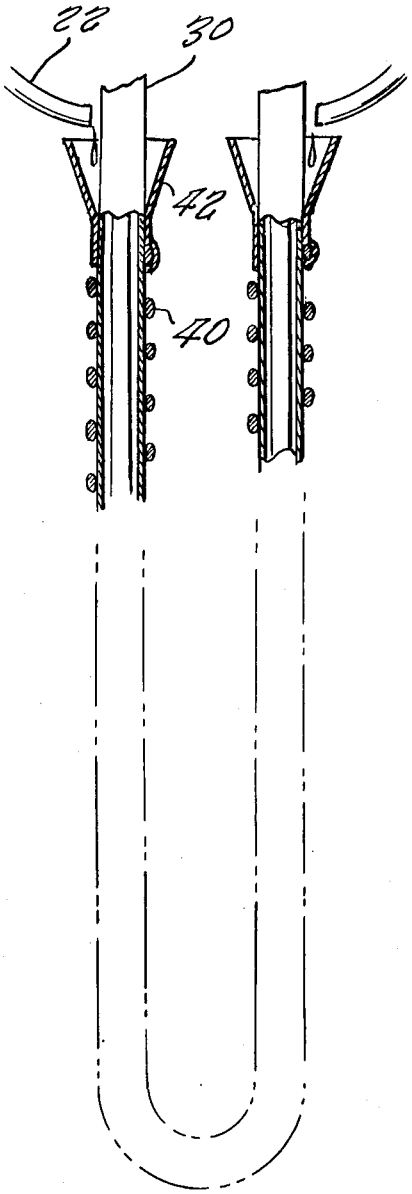
FIG. 3 is a sectional view through a portion of the heating elements showing the operation thereof.

Referring now to FIGS. 2 and 3, the heating devices will be shown in more detail. The heating devices 28 each include a U-shaped electrical heating element 30 having the ends connected to electrical terminals 32 and 34 which are in turn connected to a source of electrical supply 36. The heating element 30 is mounted onto a head support 38 which permits it to be easily installed and held in place in the mixing tank. One such typical heating element is available under the name CALROD, produced by the General Electric Company.

Around the outside of the heating element is wound a spiral retaining path 40 which can be formed of a material which will retain the liquid. By way of example, it can be formed of stranded wire, such as picture frame wire, or other similar material. Adjacent the ends of the legs of the U-shaped heating element are placed funnels 42. The ends of the stranded wire 40 shown at 44 are inserted between the lower portion 46 of the funnel and the heating element 30.

The ends of the capillary tubes 22 are positioned adjacent the openings of the funnels 42. The other ends of the tubes 22 ultimately reach to the fuel supply tank 10. The liquid fuel is controlled so that it will provide the fuel at a drop rate. The drops are collected by the funnels 42 to prevent any of the fuel from escaping and being wasted. The funnels then direct the fuel into the stranded wire which retains the fuel and directs it in a spiral path around the heating rod. As the fuel proceeds along the spiral path, it is heated by the heating rods so that it turns into fine fumes or a type of vapor fuel.

Referring back to FIG. 1, it will be seen that the mixing tank 26 includes an air inlet 48 where air can be applied at a low pressure. The pressure valves 50 and 52 provide the appropriate control of the pressure and also emergency pressure release, as needed. The air entering into the mixing tank is permitted to pass across the heating elements 28 and to mix with the fumes of the fuel. This mixture of air and fuel vapor passes across the mixing tank and leaves through the connecting tubes 54 provided in parallel at the output of the mixing tank 26. The mixture passes into a storage tank 56. The storage tank 56 is shown interconnected by means of a brace 58 to the main mixing tank 26. At the outlet of the storage tank 56 is connected a supply tube 59 with a control valve 60 in series therewith. The mixture of air and fuel fumes passes through the tube 59 to a conventional burner 62 including a burning element 64 therein. The fuel is then permitted to burn as shown at 66. Appropriate drain elements 68 are provided at the bottoms of each of the tanks as well as the burner as is well known in the art.

The operation of the fuel burning system will now be explained. The liquid fuel is provided either by a gravity feed or pressure feed, or the like, through the tubes which enter into the supply tank which is otherwise sealed. The liquid fuel is sent directly to the tops of the heating spiral elements. The needle valves in the tubing are controlled so that the liquid is applied onto heating elements in a drop like fashion.

The electrical heating elements are connected to a heat supply and the appropriate temperature set by means of the control 70, as is well known in the art. The fuel is collected by the funnels and is directed around the spiral path to thereby allow enough time to convert the oil into fine fumes and develop the fumes. These fumes are then mixed with air to produce the appropriate combustible mixture so that a mere spark can cause the mixture to burn with the greatest efficiency producing a tremendous economy with little pollution. The mixing tank permits the air to enter at a low pressure. This can be provided by means of an air blower, or the like, as is well known. The air passes across the heating elements and leaves through a number of outlet holes connected with tubing, such as copper tubing. The air pressure can be approximately one pound or thereabout.

The mixture passes through the storage tank and into the burner. The burner head can consist of a series of holes of 40,000 drill size or the like, placed in a circle or other similar shape. When the fumes mixed with air pass through these holes it causes a little separation which allows more air inbetween and creates an ideal condition for burning the fumes.

It has been discovered that with the present apparatus, there is achieved a tremendous improved efficiency over conventional prior art types of equipment. For example, one gallon of fuel has been found to provide as much heat as six times as much when utilizing conventional equipment. Furthermore, because of the design of the present equipment, substantially every drop of oil fed into the equipment is utilized so that there is almost no loss of fuel in the system. For example, the use of the funnel makes sure that all of the fuel is directed into the spiral and also prevents the air from blowing the oil drops away from the spiral element.

When fed in the drop like manner, the forces that hold the molecular structure of the fuel as a liquid can change as a result of the spiral flow around the heating element. This permits the fuel to become a very fine vapor. With this process, the natural state of the fuel is not destroyed. However, it is converted into a vapor like fume which permits it to combine easily with the air. As a result, it burns more efficient and extremely clean. For example, it has been found that the resultant flame is odorless and does not produce any soot.

The present apparatus has been in operation for a period of time and it has been found that the walls around the apparatus are almost entirely sootless. Also, a shiny aluminum plate or the like inserted into the flame has been found to produce no soot on the plate. Other similar tests have been carried out to note that the result is almost no pollution while producing the efficienct output.

Although the heating element has been described by means of wrapping around the heating element, the heating device can be manufactured as a unitary element with the spiral effect already included around the device itself. This would produce a unique type of spiral heating element which would direct all of the fuel around the heating element providing sufficient time for it to become transformed into its vapor like state. However, it is believed that in addition to the spiral arrangement, similar types of arrangements could also be included whereby sufficient time is provided so that all of the liquid fuel will be retained around the surface of a heating element giving it enough time and opportunity to be converted from its liquid state into the vapor like fume state needed to combine with the air.

By way of example, the invention has been tried with various types of heating fuel. It has been found that efficient operation is achieved when utilizing a heating number 2 fuel as well as oils or kerosene. Used engine oil when strained produces efficient results.

In order to compare the extremely efficient and sootless operation, various types of oil burners have been compared. Utilizing a standard type of oil burner as is used in a home, it has been found that only 30%–40% of efficiency is obtained. Thus, in utilizing fuel, only a portion of the total available energy can be achieved. It has been found that one gallon of number 2 fuel oil can theoretically produce 140,000 BTU. However, this is only in theory. With the 30–40% efficiency, the home unit can only realize 42,000–56,000 BTU from one gallon of such fuel oil. The reason for such low efficiency is that the stack temperature is approximately 600° F.–700° F. Therefore, a large percentage of the heat goes up the chimney as waste product.

The most efficient type of conventional oil burner is the Custom Mark III Oil Unit, produced by the Axel-Anderson Company, Williamsport, Penna. This is approximately 60% efficient since it utilizes redirection of the fuel and reburning of the fuel product. As a result, the stack temperature is reduced to about 350° F.–400° F. As a result, from one gallon of number 2 fuel oil, approximately 84,000 BTUs can be obtained.

The present invention has been found to produce a stack temperature of about only 10° F. above the ambient temperature. It will be noted that this is extremely low in comparison to conventional burners. As a result, the efficiency produced is better than 99%.

As is evident from the foregoing description, one of the reasons for this efficiency is that substantially all of the fuel is evaporated and converted into a vapor like product which is mixed with the air to produce the combustible material. Accordingly, there is little waste of fuel. Furthermore, because the fuel is all converted into the vapor like material, there are no particles which can escape to produce waste. Furthermore, in most prior art systems, the air is supplied by means of force feeding utilizing a blower or high pressure air input. This high pressure tends to send alot of the heat up the stack producing great amount of wasted energy. Because the present system utilizes extremely low pressure air, there is no force for pushing the fuel and air mixture into the stack as waste product.

An additional reason for the efficiency is that the fuel is evaporated at a controlled temperature. In the prior systems the fuel is left to evaporate at either normal or very low temperatures whereby much of the fuel will remain in its liquid state with very little vapor being produced. On the other hand, some systems will rely on the walls of the burner itself to produce the evaporation and when these get too hot the entire molecular structure of the fuel is broken down and byproducts are produced which result in great waste. By means of the unique heating elements of the present invention, appropriate control of the heating temperature is obtained whereby all of the fuel is converted into vapor while at the same time the fuel does not break down but rather remains as fuel but only the bonds holding together the molecular structure as a liquid are separated to produce the very fine vapor, There has been disclosed heretofore the best embodiments of the invention presently contemplated. However it is to be understood that various changes and modifications may be made thereto without departing from the spirit of the invention.

We claim:

1. A fuel burning apparatus comprising:

receiving means for receiving a liquid fuel and dispensing it a drop at a time;

heating means comprising at least one heating element and stranded wire spirally wound about the heating element, the stranded wire receiving the drops of liquid fuel from the receiving means and directing the drops of liquid fuel through the wire and around the heating element for converting the liquid fuel into fine fumes;

mixing means comprising a mixing tank having an air inlet means and outlet means, said heating element being positioned in said mixing tank such that air from said air inlet means can traverse said heating element to mix with the fumes, said mixture leaving through said outlet means;

burner means for burning the mixture of air and fine fumes, and conveying means for supplying said mixture from said mixing means to said burner means.

2. A fuel burning apparatus as in claim 1 and wherein said heating element is a U-shaped electrical heating element having the ends thereof capable of connection to an electrical power supply, and wherein said receiving means comprises funnels adjacent the ends of the legs of the U-shaped heating element, the ends of the stranded wire being respectively held between said funnels and said heating element.

3. A fuel burning apparatus as in claim 1 and wherein there are a plurality of said heating elements connected in said mixing tank in parallel relationship with each other.

4. A fuel burning apparatus as in claim 1 and wherein said mixing means further comprises a gravity feed system for supplying liquid fuel to the receiving means.

5. A fuel burning apparatus as in claim 4 and further comprising control valve means interconnected between said gravity feed means and said mixing means for regulating the supply of liquid fuel to the drip rate.

6. A fuel burning apparatus as in claim 1 and wherein said conveying means comprises a storage tank, a plurality of conveying tubes interconnecting said outlet means with said storage tank, and a supply tube interconnecting said storage tank with said burner means.

7. A fuel burning apparatus as in claim 1 and further comprising pressure control means for supplying the air at said air inlet means at a low pressure.

8. A fuel burning apparatus as in claim 2 and further comprising temperature control means for controlling the heating of said electrical heating elements.

9. A method of burning fuel comprising:

forming a spiral path of stranded wire about a heating element;

supplying a liquid fuel at a drop rate on the stranded wire;

heating the heating element as the drops of fuel pass through the stranded wire about the heating element to convert it into fine fumes;

mixing the fine fumes with air by passing air at a low pressure across the heating element; and supplying the mixture of air and fine fumes to a burning device to form the mixture.

10. A method as in claim 9 and wherein said heating element is contained in a chamber, and wherein said steps of mixing comprises the steps of blowing air through said chamber so that it crosses the heating element and can mix with the fumes.

11. A method as in claim 9 and further comprising the step of controlling the temperature of the heating element to thereby regulate the rate of conversion into fine fumes.

12. A method as in claim 9 and further comprising the steps of placing a funnel about the leg of the heating element adjacent its ends to catch the fuel applied thereon, and to direct it into the spiral path around the heating element.

13. A method as in claim 12 and wherein said step of forming the spiral path comprises the step of wrapping a stranded wire about a U-shaped heating element, positioning a funnel at the end of each leg, and locating the ends of the wire between the funnel and the heating element.

14. A method as in claim 9 and wherein said step of applying the fuel uses a gravity feed supply.

15. A spiral heating element for use as a heating device for converting liquid fuel into fine fumes for use in a fuel burning apparatus, said spiral heating element comprising:

a heating element having a spiral path of stranded wire therearound, and receiving means coupled to said element for receiving the liquid fuel and directing it into said spiral path, whereby the liquid fuel flows through the stranded wire around said heating element until it is converted almost entirely into fine fumes.

16. A spiral heating element as in claim 15 and wherein said heating element is a U-shaped electrical heating element having the ends thereof capable of connection to an electrical power supply, and wherein said receiving means comprises funnels adjacent the ends of the legs of the U-shaped heating element, the ends of the stranded wire being respectively held between said funnels and said heating element.

17. A spiral heating element as in claim 15 and wherein said spiral path is integrally formed in a single unit with said heating element.

* * * * *